US011371684B1

(12) United States Patent
Hawkins et al.

(10) Patent No.: US 11,371,684 B1
(45) Date of Patent: Jun. 28, 2022

(54) HINGED DRIVER HOUSING FOR LIGHTING SYSTEM AND LIGHTING SYSTEM INCLUDING SAME

(71) Applicant: Troy-CSL Lighting Inc., City of Industry, CA (US)

(72) Inventors: Jacob Hawkins, Sierra Madre, CA (US); Calvin Wong, Diamond Bar, CA (US)

(73) Assignee: Troy-CSL Lighting Inc., City of Industry, CA (US)

( * ) Notice: Subject to any disclaimer, the term of this patent is extended or adjusted under 35 U.S.C. 154(b) by 0 days.

(21) Appl. No.: 17/219,642

(22) Filed: Mar. 31, 2021

(51) Int. Cl.
*F21V 23/00* (2015.01)
*F21V 23/06* (2006.01)

(52) U.S. Cl.
CPC ..... *F21V 23/007* (2013.01); *F21V 23/001* (2013.01); *F21V 23/06* (2013.01)

(58) Field of Classification Search
CPC ..... F21V 23/007; F21V 23/06; F21V 23/001; F21V 21/04; F21V 23/008; F21V 17/107; F21V 23/023; F21S 8/02; F21S 8/8026; H05K 5/0226
See application file for complete search history.

(56) References Cited

U.S. PATENT DOCUMENTS

| | | | | |
|---|---|---|---|---|
| 6,659,627 | B2 | 12/2003 | Caluori | |
| 7,967,481 | B2 | 6/2011 | Seo | |
| 7,993,037 | B1 | 8/2011 | Buse | |
| 8,021,007 | B2 | 9/2011 | Rapeanu et al. | |
| 8,519,266 | B2 | 8/2013 | Sartini | |
| 8,854,796 | B2 | 10/2014 | Wilcox | |
| 9,206,968 | B2 | 12/2015 | Highbridge | |
| 9,325,134 | B2 * | 4/2016 | Lopez | H01R 35/00 |
| 9,664,347 | B1 | 5/2017 | Wronski et al. | |
| 9,693,432 | B2 * | 6/2017 | Ando | F21S 8/026 |
| 10,502,375 | B2 * | 12/2019 | Steadman | F21V 13/04 |
| 11,032,893 | B2 * | 6/2021 | Major | H05B 47/185 |
| 11,067,231 | B2 | 7/2021 | Lotfi et al. | |
| 2012/0287616 | A1 * | 11/2012 | Wilcox | F21V 23/023 362/198 |
| 2013/0207552 | A1 * | 8/2013 | Plunk | F21S 8/02 315/152 |
| 2015/0078012 | A1 * | 3/2015 | Delano | F21S 8/02 362/365 |
| 2019/0128488 | A1 * | 5/2019 | Trang | F21S 8/026 |

FOREIGN PATENT DOCUMENTS

| | | | | |
|---|---|---|---|---|
| EP | 1 378 708 | A2 | 1/2004 | |
| EP | 2 570 719 | A1 | 3/2013 | |
| EP | 2570722 | * | 3/2013 | F21S 8/02 |
| WO | WO-2017/176388 | A1 | 10/2017 | |

* cited by examiner

*Primary Examiner* — Peggy A Neils
(74) *Attorney, Agent, or Firm* — Foley & Lardner LLP

(57) ABSTRACT

A driver housing for holding driver electronics of a lighting device system includes a first housing portion and a second housing portion. The first housing portion is configured to hold and retain the driver electronics. The second housing portion is configured to contain or hold one or more electrical connectors for connecting the first one or more electrical conductors to the one or more power source conductors. A pivotal joint connects the first housing portion and the second housing portion together, for pivotal movement relative to each other. The pivotal joint improves the ease and ability of installation of the driver housing in small or narrow spaces.

22 Claims, 7 Drawing Sheets

HINGED DRIVER HOUSING FOR LIGHTING SYSTEM AND LIGHTING SYSTEM INCLUDING SAME

BACKGROUND

Modern lighting systems often include a lighting device and driver electronics. The lighting device has a light source for emitting light, such as one or more light emitting diodes (LEDs). The driver electronics are configured to be electrically connected to the light source and to one or more electrical power conductors located in an installation environment. The driver electronics provides an appropriate electrical power signal to the LEDs, to activate the LEDs to emit light.

In many lighting systems and installation environments, the driver electronics are separated from the light source, but are located near and are electrically connected to the light source through electronic conductors. In certain lighting systems such as, but not limited to, room or area lighting systems, the lighting device may be configured to be mounted on or in (or partially in) a ceiling, wall, housing or other structure. In such systems, it may be desirable to mount the driver electronics in a generally enclosed environment near the lighting device (and, often, out of view), such as in a plenum space, an inner wall space, or a recess of a ceiling, wall, housing or other structure.

In those or other contexts, it may be difficult to install and fit the driver electronics in the plenum space, an inner wall space, recess, or other generally enclosed environment. Alternatively or additionally, it may be difficult to access the driver electronics (e.g., for inspection, servicing, or replacement), after the driver electronics are installed in the generally enclosed environment. Accordingly, it can be desirable to provide driver housing configurations for a lighting device system, and lighting device system configurations that include such driver housings, where the driver housings are configured to allow for ease of installation and ease of access to the driver electronics.

SUMMARY

An example of a lighting device system includes a lighting device assembly having a light source for generating light. Driver electronics is connected to provide one or both of a power signal or a control signal to the light source. The driver electronics includes a first one or more electrical conductors for electrical connection to one or more power source conductors, and a second one or more electrical conductors electrically connected to the light source. A driver housing is separated from the lighting device assembly, and connected to the light source through at least one electrical conductor. The driver housing has a first housing portion that holds and retains the driver electronics. A second housing portion is configured to contain or hold one or more electrical connectors for connecting the first one or more electrical conductors to the one or more power source conductors. A pivotal joint connecting the first housing portion and the second housing portion together, for pivotal movement relative to each other.

In a further example of the lighting device system, the first one or more electrical conductors extend from the driver electronics held by the first housing portion, to the second housing portion.

In a further example of the lighting device system, the second housing portion includes a connector for connecting to an electrical cable, the connector being selectively connected and selectively disconnected from a connected state.

In a further example of the lighting device system, the first housing portion has an interior cavity in which the driver electronics are contained, where the second housing portion has an interior cavity in which the one or more electrical connectors are contained.

In a further example of the lighting device system, the first housing portion has a wall that is selectively moveable or removable to allow access to the interior cavity of the first housing portion for installation, removal, inspection or servicing of the driver electronics.

In a further example of the lighting device system, the second housing portion has a wall that is selectively moveable or removable to allow access to the interior cavity of the second housing portion for connection, disconnection, inspection or servicing of the driver electronics.

In a further example of the lighting device system, the first housing portion has a side facing the second housing portion, and at least one first protrusion or flange extending from that side, the second housing portion has a side facing the first housing portion, and at least one second protrusion or flange extending from that side, and the pivotal joint comprises at least one pivot pin or axel extending between the at least one of the first or second protrusion or flanges to pivotally connect the at least one first protrusion or flange with the at least one second protrusion or flange.

In a further example of the lighting device system, the second housing portion has a second side facing opposite to the first side of the second housing portion, the second side defining an angle relative to one or more other sides of the second housing portion, where the angle is selected from the range of and including 20 degrees to 70 degrees.

In a further example of the lighting device system, the driver electronics includes a safety cable extending from the driver electronics to the lighting device assembly.

In a further example of the lighting device system, the first one or more electrical conductors extend through the pivotal joint, and wherein the pivotal joint includes at least one electrically conductive pivot axle that provides an electrical ground connection of the first housing portion and the second housing portion.

A further example of the lighting device system, includes a cable strain relief member provided on the first housing portion, wherein the second one or more electrical conductors extend from the driver electronics held by the first housing portion, through the cable strain relief member to the lighting device.

In a further example of the lighting device system, the second housing portion includes a connector for electrically connecting a ground conductor of the electrical cable to the second housing portion, to ground the second housing portion.

An example of a driver housing for holding driver electronics of a lighting device system, includes a first housing portion configured to hold and retain the driver electronics. A second housing portion is configured to contain or hold one or more electrical connectors for connecting the first one or more electrical conductors to the one or more power source conductors. A pivotal joint connects the first housing portion and the second housing portion together, for pivotal movement relative to each other.

A further example of the driver housing includes driver electronics configured to connect to a light source of a lighting device to provide one or both of a power signal or a control signal to the light source, the driver electronics including a first one or more electrical conductors for electrical connection to one or more power source conductors, and a second one or more electrical conductors for electrically connecting to the light source.

In a further example of the driver housing, the first one or more electrical conductors extend from the driver electronics held by the first housing portion, to the second housing portion.

In a further example of the driver housing, the second housing portion includes a connector for connecting to an electrical cable having one or more power source conductors.

In a further example of the driver housing, the first housing portion has an interior cavity configured to contain the driver electronics, where the second housing portion has an interior cavity configured to contain one or more electrical connectors for electrical connection of the one or more power source conductors with the first one or more electrical conductors.

In a further example of the driver housing, the first housing portion has a wall that is selectively moveable or removable to allow access to the interior cavity of the first housing portion for installation, removal, inspection or servicing of the driver electronics.

In a further example of the driver housing, the second housing portion has a wall that is selectively moveable or removable to allow access to the interior cavity of the second housing portion for connection, disconnection, inspection or servicing of the driver electronics.

In a further example of the driver housing, the first housing portion has a side facing the second housing portion, and at least one first protrusion or flange extending from that side, the second housing portion has a side facing the first housing portion, and at least one second protrusion or flange extending from that side, and the pivotal joint has at least one pivot pin or axel extending between the at least one of the first or second protrusion or flanges to pivotally connect the at least one first protrusion or flange with the at least one second protrusion or flange.

In a further example of the driver housing, the second housing portion has a second side facing opposite to the first side of the second housing portion, the second side defining an angle relative to one or more other sides of the second housing portion, where the angle is selected from the range of and including 20 degrees to 70 degrees.

A further example of the driver housing includes a cable connector on the second side of the second housing portion.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1:
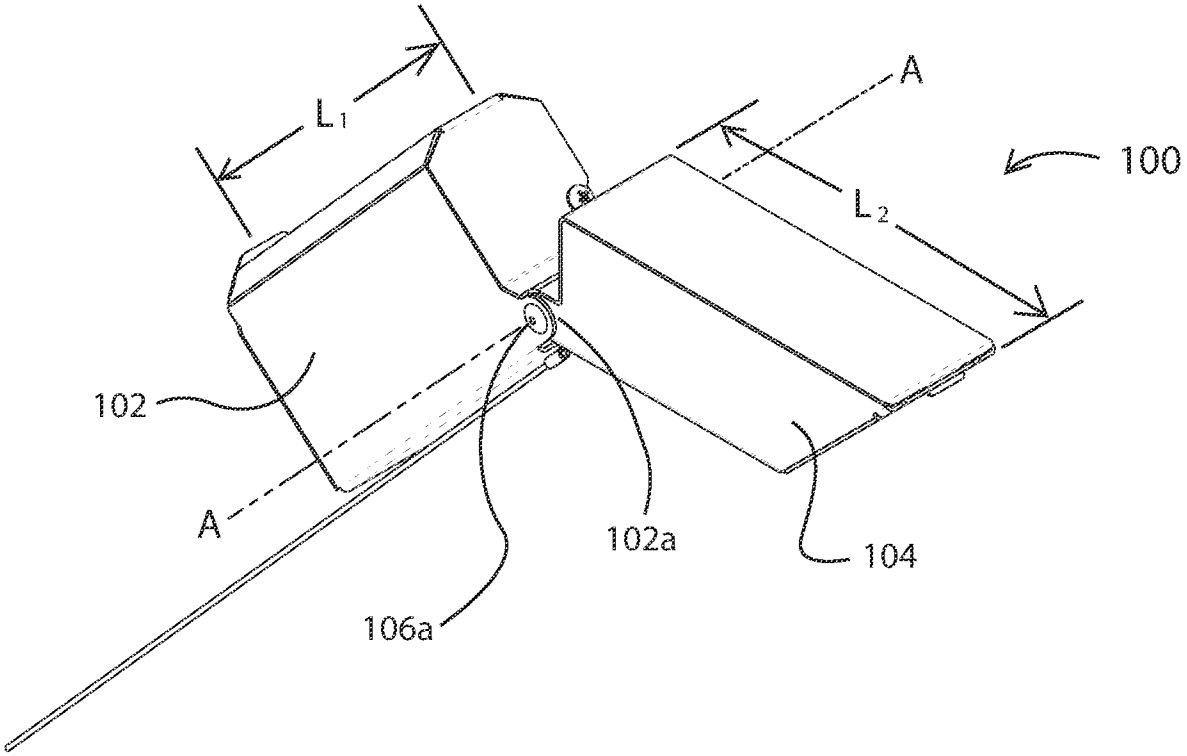
FIGS. 1 and 4 are perspective views of an example of a hinged driver housing in a bent arrangement.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," "secured to" or "attached to" another element or feature, it can be directly on, connected to, coupled to, secured to or attached to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," "generally" and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various examples described herein, a hinged driver housing (or a lighting system having a hinged driver housing) is configured to be installed in a recess or opening provided in a ceiling, wall, outer housing or other object. In some examples, the lighting system includes a lighting device configured to be installed in or partially in an opening to a plenum, duct or attic space of a ceiling, or in an inner wall space in a manner to appear flush or substantially flush with an exposed surface of a ceiling, wall or other object. In other examples, variations of the lighting device may be configured to be installed in a manner that is not flush with an exposed surface (and, instead, is configured to be recessed or protruding from the exposed surface of a ceiling, wall, outer housing or other object), or is configured to be surface-mounted on the exposed surface of the ceiling, wall, outer housing or other object. In yet other examples, variations of the lighting device may be configured to be mounted on a support structure (such as, but not limited to a sconce structure, pedestal, shaft or the like). In yet other examples described herein, the lighting device may be mounted in other suitable locations or environments. In each of those examples, the lighting device is configured to be connected to driver electronics located in the hinged driver housing. The driver housings may be configured to allow for ease of installation of and access to the driver electronics within the driver housings.

Driver housings according to examples described herein (and lighting device systems that include such driver housings) can be configured for ease and efficiency of installation and accessibility. By improving the installation and accessibility capabilities, a user may readily and efficiently install or remove the lighting system or the driver electronics (or both), or may readily and efficiently access the driver electronics or the electrical connections to the driver electronics to replace, inspect, or service the driver electronics or electrical connections (or both).

Figure 5:
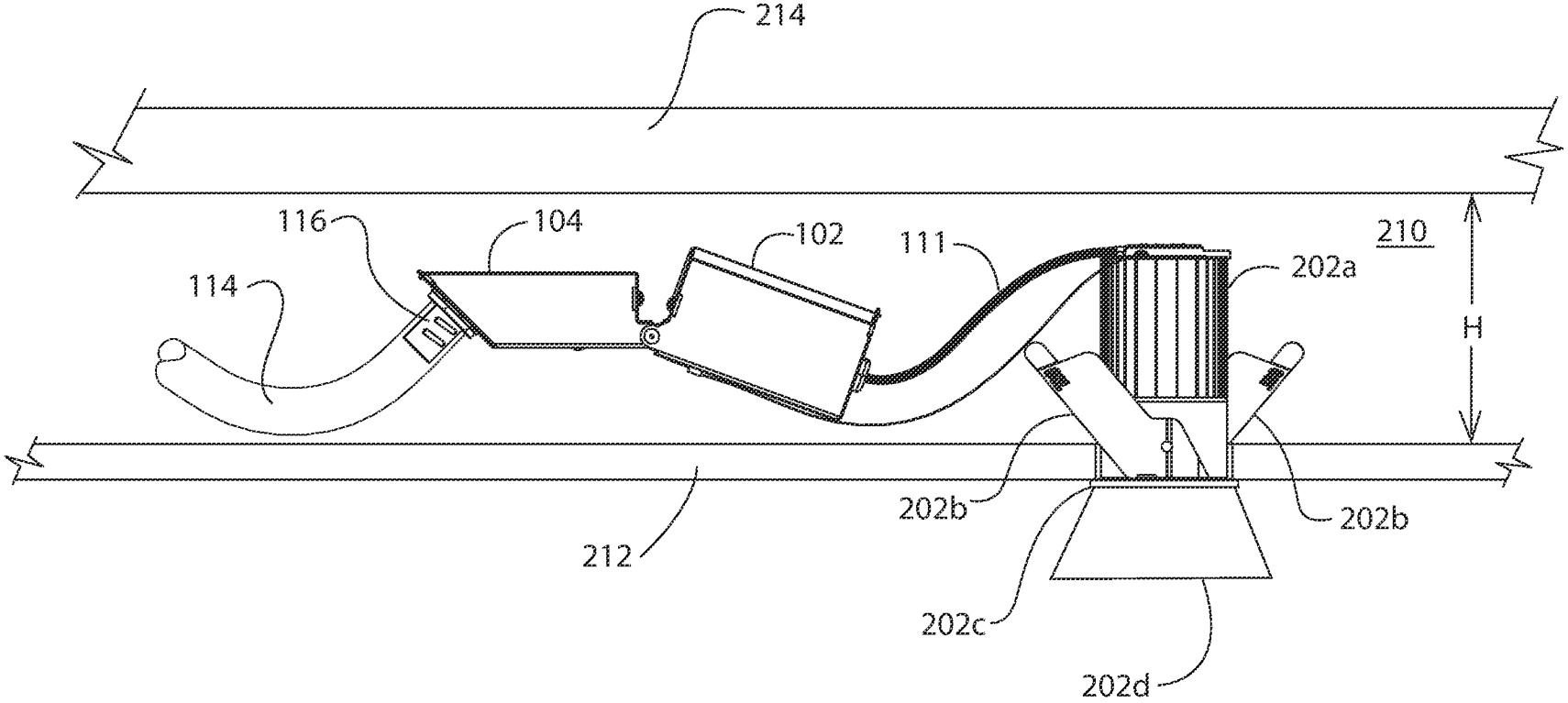
FIG. 5 is a side-schematic view of an example of an assembled lighting device system that includes a hinged driver housing of FIG. 1, installed in an example installation environment.
Figure 6:
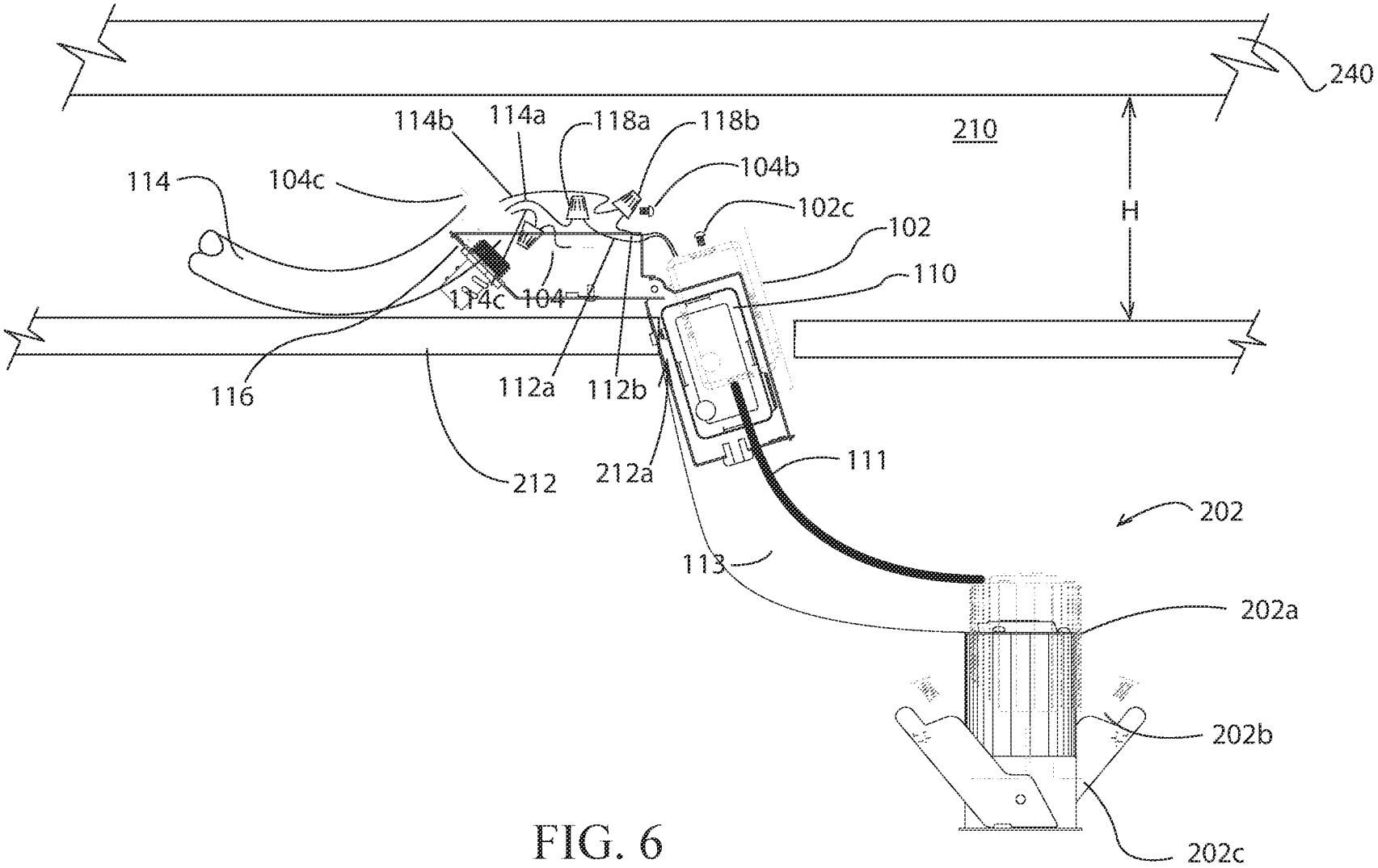
FIG. 6 is a side-schematic view of the lighting device system example of FIG. 3, partially installed in the installation environment.
Figure 7:
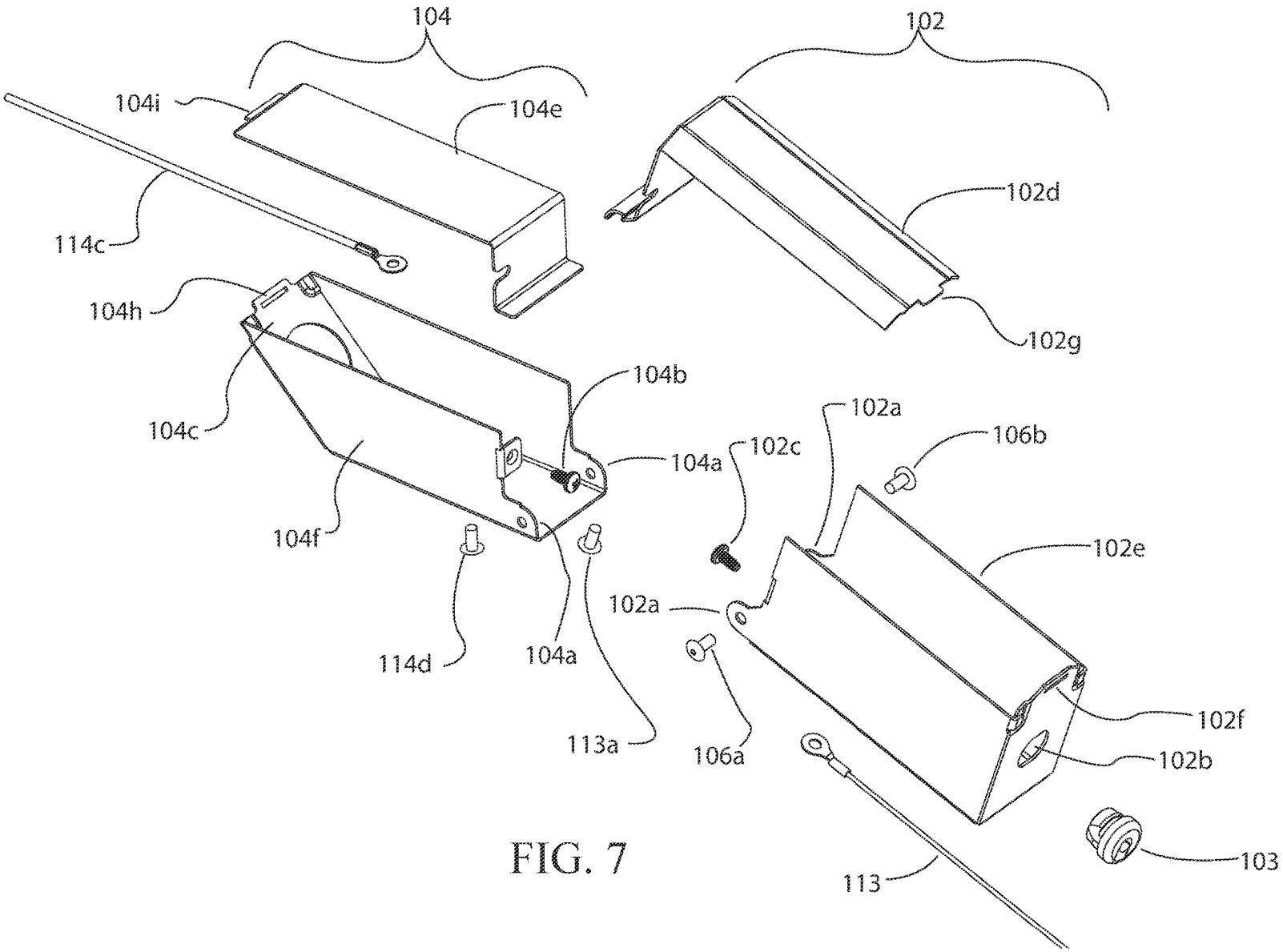
FIG. 7 is an exploded view of the example hinged driver housing of FIGS. 1-4.

The drawings in FIGS. 1-4 are perspective views of an example of a hinged driver housing 100. FIG. 5 shows an example of a lighting system 200 that includes a hinged driver housing 100 and that has been installed in a ceiling environment. A cross-section view of an example of the lighting system 200, including the driver housing 100, in a state of being installed or being removed from an installed state is shown in FIG. 6. FIG. 7 is an exploded view of the example hinged driver housing 100 of FIGS. 1-4.

In those drawings, the hinged driver housing 100 includes a first housing portion 102, a second housing portion 104, and a hinge or pivot joint 106. The hinge or pivot joint 106 connects the first housing portion 102 and the second housing portion 104 together, for pivotal movement relative to each other, about a pivot axis A. In particular examples, the hinge or pivot joint 106 also provides or enhances an electrical ground connection of the first housing portion 102 to the second housing portion 104.

The hinge or pivot joint 106 allows the first and second housing portions 102 and 104 to be pivoted relative to each other, to change and adjust an angle between (or defined by) the housing portions 102 and 104. For example, in FIGS. 1 and 4, the hinged driver housing 100 is shown in a bent configuration, with the first and second housing portions 102 and 104 in a non-linear arrangement relative to each other, in which the longitudinal axis and dimensions $L_1$ and $L_2$ of the housing portions are transverse to each other to define a non-linear angle (e.g., an oblique or an orthogonal angle). In FIGS. 2 and 3, the same driver housing 100 is shown in a generally linear configuration, with the first and second housing portions 102 and 104 having their longitudinal axes and dimensions $L_1$ and $L_2$ in generally a linear alignment (or more linear alignment than in FIGS. 1 and 4) with each other (for example, defining a 180 degree angle or closer to a 180 degree angle than in FIGS. 1 and 4).

Figure 2:
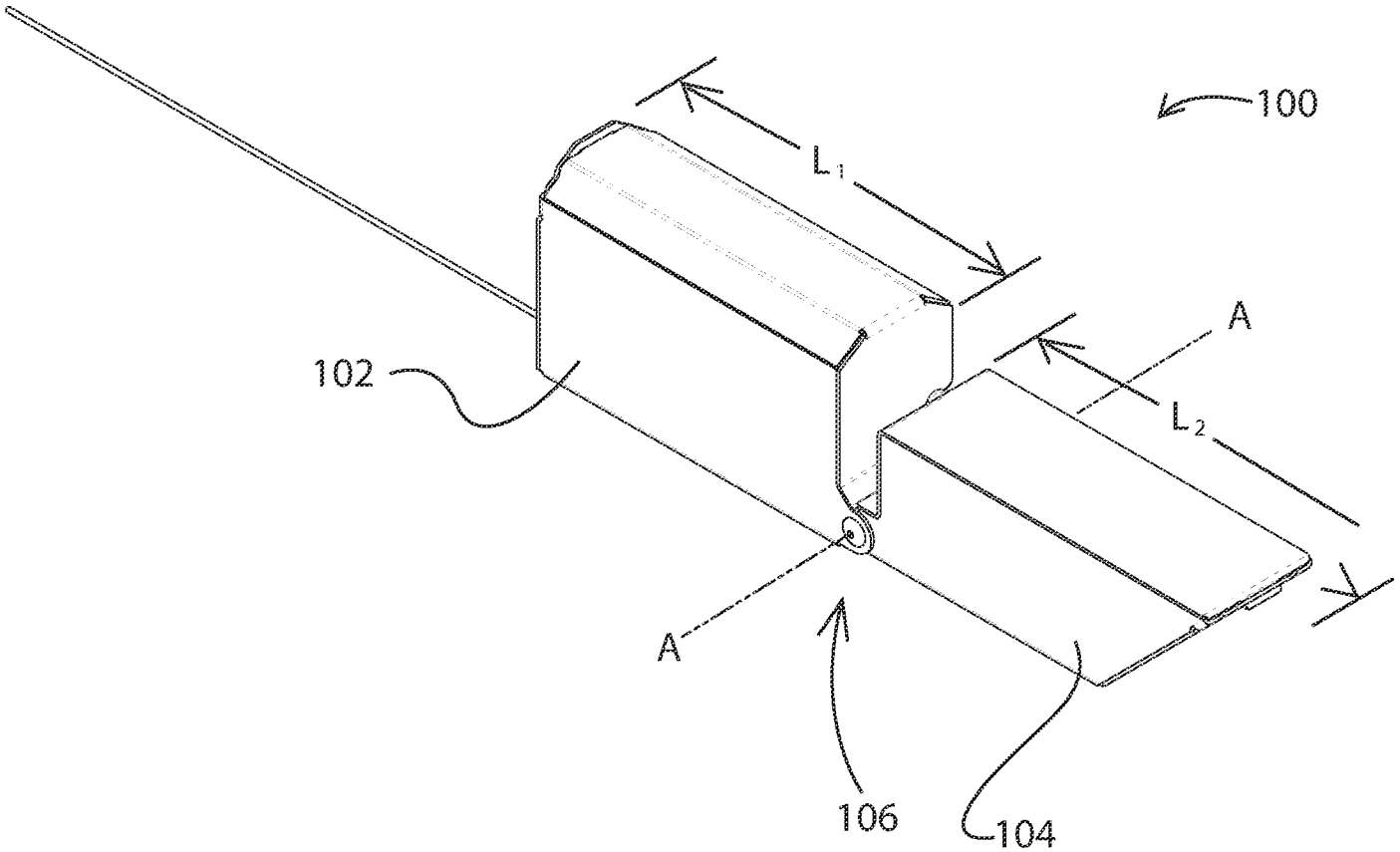
FIGS. 2 and 3 are perspective views of the hinged driver housing of FIG. 1, but in an unbent or generally linear arrangement.
Figure 3:
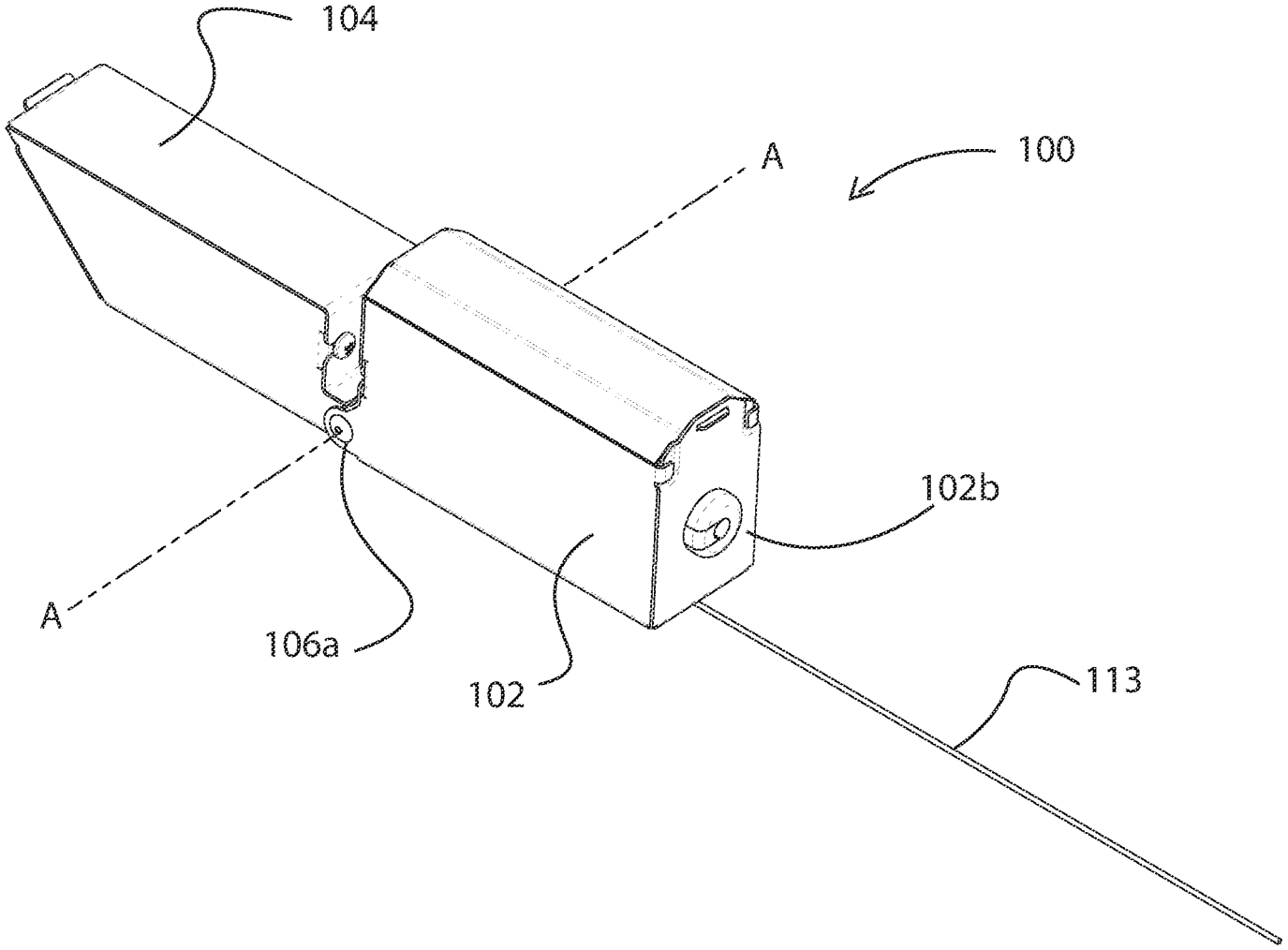
Figure 4:
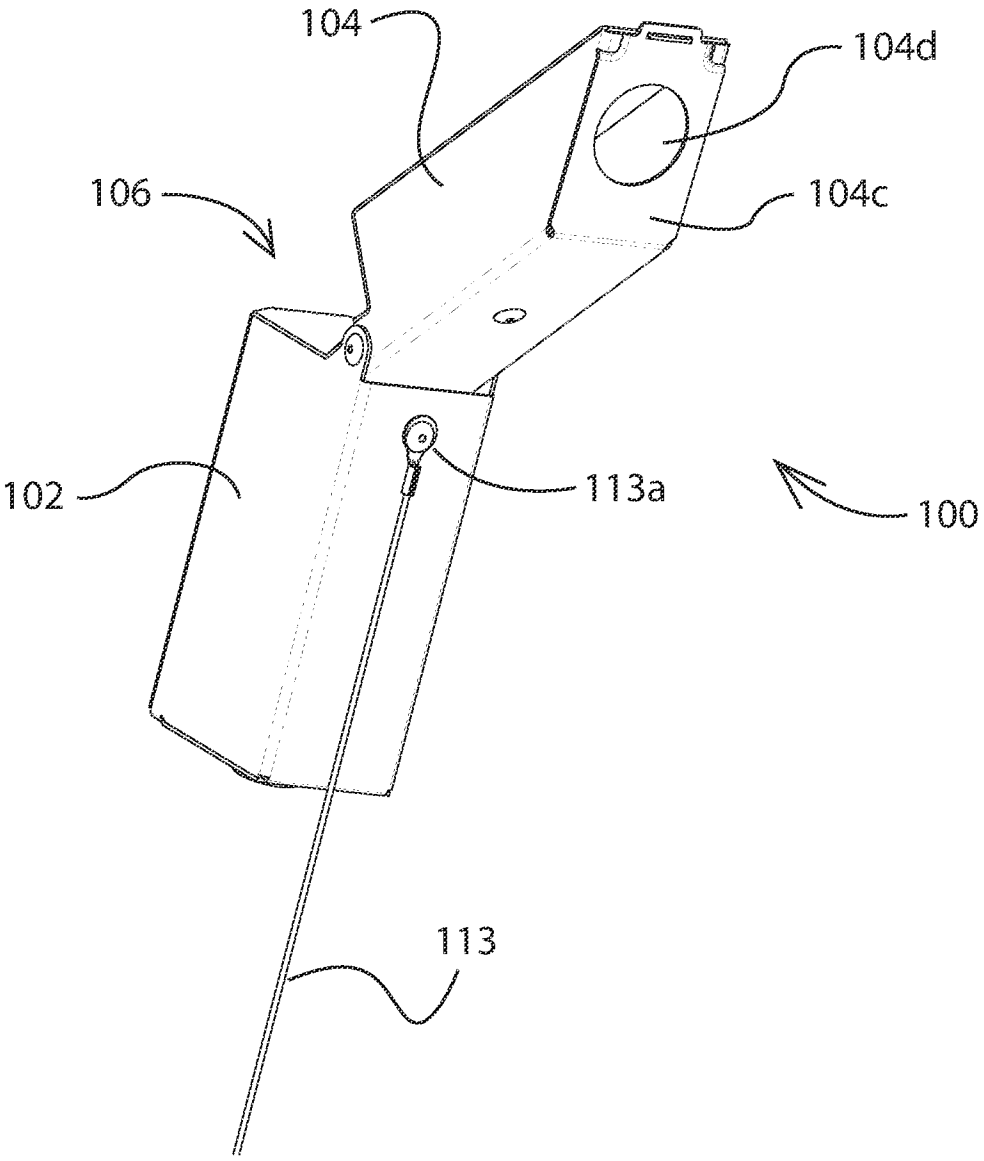

In particular examples, the hinged driver housing 100 may be selectively bent or pivoted at the pivot joint 106 to any angled arrangement allowed by the pivot joint, including and between a linear arrangement as shown in FIGS. 2 and 3 to and beyond the angle shown in FIGS. 1 and 4. In some examples, the pivot joint 106 is configured to allow the first and second housing portions 102 and 104 to be pivoted to a position at which a side of the first housing portion 102 (e.g., the side facing downward and out of view in FIGS. 1-3) engages and contacts a side of the second housing portion 104 (e.g., the side facing downward and out of view in FIGS. 1-3).

In the example in FIGS. 1-6, the first housing portion 102 has a generally rectangular, cuboidal shape, including side walls and end walls that surround and enclose an interior cavity. The first housing portion 102 has one or more flanges **102*a* extending outward toward the second housing portion 104. In other examples, the first housing portion 102 may have other suitable shapes including, but not limited to cylindrical shapes, tapered or conical shapes, spherical shapes or combinations thereof. The first housing portion 102 has a hollow or partially hollow interior cavity for containing driver electronics 110. In particular examples, the cavity of the first housing portion is empty and a user may place driver electronics 110 into the cavity as part of an assembly or installation method, when a lighting system is being assembled or installed. In other examples, the driver housing 100 may include and be provided with driver electronics 110 within the cavity of the first housing portion 102. The driver electronics 110 is configured to connect to a lighting device of the lighting system 200, as shown in FIGS. 5 and 6** and described herein.

The driver electronics 110 may be configured to convert power provided from a power source (such as the cable 114 described below). In examples in which the light source in the lighting device is an LED light source, the driver electronics 110 includes one or more LED drivers to convert power from the power source to a power signal suitable to drive the LED light source. In some examples, the driver electronics 110 includes an AC to DC converter. In some examples, the driver or electronics 110 may include a processor to execute instructions stored on memory (e.g., non-transient computer readable media) to process data and/or to control various functions of the lighting device (e.g., temperature, light output, color of light, direction of light, focus of light, and/or the like). The driver electronics 110 has or is connected to one or more (or a plurality of) output conductors (represented by cable 111 in FIGS. 5 and 6) for providing output power or control signals (or both) to the lighting device of the lighting system 200. The first housing portion 102 may include an opening 102*b* on a side facing opposite the second housing portion 104, for the electrical cable 111 to pass through from the driver electronics 110 in the interior cavity of the first housing portion 102. In some examples, a strain relief member 103 may be located in the opening 102*b* (for example, by press fit, molding or other suitable connection mechanism), to grip the electrical cable 111 and reduce strain on the driver electronics 110. The driver electronics 110 also has or is connected to one or more (or a plurality of) input conductors (represented by conductors 112*a* and 112*b*) for receiving input power or control signals (or both) from a power signal source (e.g., cable 114) or a control signal source (or both).

In certain examples, a safety cable 113 may be connected to and between the hinged driver housing 100 and the lighting device of the lighting system 200. The safety cable 113 may connect to the first housing portion 102 by any suitable fastener 113*a* that provides sufficient connection strength including, but not limited to a screw, a bolt or other threaded connector, a rivet, or the like. In those examples, the safety cable 113 may include a flexible cable or cord of sufficient strength to provide a safety leash that can support the weight of the light device freely hanging from the driver electronics 110 (and the driver housing 100), for example, during installation or removal of the lighting system 200.

In certain examples, the first housing portion 102 is configured to be selectively opened or closed to access the cavity to place driver electronics within or remove driver electronics from the cavity. Such selective opening and closing of the cavity may be provided by any suitable door, shutter or other opening and closing mechanism. In some examples, such opening and closing of the cavity may be provided by a fastener 102*c* (such as, but not limited to a threaded screw or bolt, or a clip) that holds one or more removable walls 102*d* of the first housing portion 102 to the base 102*e* of the first housing portion, and may be selectively removed or released to temporarily remove the wall. In other examples, the driver electronics 110 may be sealed within the cavity of the first housing portion 102 and not ordinarily accessible to a user during installation. In particular examples, the driver electronics 110 is provided in the form of a module in which the driver electronics are encased or partially encased in a module housing to be received in the cavity of the first housing portion 102 as a unitary structure.

The first housing portion 102 (including the wall or walls 102*d* and the base 102*e*) may be made of any suitable rigid material or materials including, but not limited to metal, plastic, ceramic, composite material, wood, combinations thereof, or other suitable material or materials. In particular examples, the first housing portion 102 is made of an electrically conductive material such as, but not limited to a conductive metal. In such examples, the hinged driver housing 100 may be electrically connected to a ground conductor and provide a portion of a ground path, as described below. In some examples, the wall or walls 102*d* and the base 102*e* of the first housing portion 102 are made of one or more pieces of a sheet metal material that are bent into the shape of the first housing portion. In other examples, the first housing portion 102 is made by other suitable manufacturing techniques including, but not limited to, molding, machining, bonding wall panels together, or the like.

The first housing portion 102 has a first end side facing the second housing portion 104. The first housing portion 102 includes one or more extensions or flanges 102*a* extending from the first end (where two flanges 102*a* are in the example of FIG. 7), for connection with one or more pivot pins or axels (two pivot pins or axels 106*a* and 106*b* in the example of FIG. 7) to define the joint 106. In particular examples, the extensions or flanges 102*a* are formed unitary with a side wall of the first housing portion 102. In other examples, the extensions or flanges 102*a* are formed separate from the rest of the first housing portion 102 and are connected to a side wall of the first housing portion 102 by any suitable connection mechanism including, but not limited to one or more screws, bolts or other threaded fasteners, clips, friction fitting, adhesives, welding, heat staking, combinations thereof, or the like.

In the example in FIGS. 1-6, the second housing portion 104 has a generally rectangular, cuboidal shape, with a tapered or angled side. The second housing portion 104 has one or more flanges 104*a* extending outward toward the first housing portion 104. In other examples, the second housing portion 104 may have other suitable shapes including, but not limited to cylindrical shapes, tapered or conical shapes, spherical shapes or combinations thereof. The second housing portion 104 may be made of any suitable rigid material or materials including, but not limited to metal, plastic, ceramic, composite material, wood, combinations thereof, or other suitable material or materials. In particular examples, the second housing portion 104 is made of an electrically conductive material such as, but not limited to a conductive metal. As described herein, in such examples, the hinged driver housing 100 may be electrically connected to a ground conductor and provide a portion of a ground path. In some examples, the second housing portion 104 is made of one or more pieces of a sheet metal material that is bent into the shape of the first housing portion. In other examples, the second housing portion 104 is made by other suitable manufacturing techniques including, but not limited to, molding, machining, bonding wall panels together, or the like.

The second housing portion 104 has a first end side facing the first housing portion 102. The second housing portion 104 includes one or more extensions or flanges 104*a* (two flanges 104*a* connected by a portion of the bottom of the second housing portion 104 in FIG. 7) extending from the first end side, for connection with the pivot pins or axels

106*a* and 106*b* to define the joint 106. In particular examples, the extensions or flanges 104*a* are formed unitary with a side wall of the second housing portion 104. In other examples, the extensions or flanges 104*a* are formed separate from the rest of the second housing portion 104 and are connected to a side wall of the second housing portion 104 by any suitable connection mechanism including, but not limited to one or more screws, bolts or other threaded fasteners, clips, friction fitting, adhesives, welding, heat staking, combinations thereof, or the like.

The one or more extensions or flanges 104*a* of the second housing portion 104 align with the one or more extensions or flanges 102*a* of the first housing portion 102. The pivot pin or axel 106*a* may extend through axel openings in the flanges 102*a* and 104*a*, to pivotally connect the flanges 102*a* and 104*a* (and to pivotally connect the first and second housing portions 102 and 104) together. Each pivot pin or axel 106*a* and 106*b* may be made of any suitable rigid material or materials including, but not limited to metal, plastic, ceramic, composite material, wood, combinations thereof, or other suitable material or materials. In particular examples, the pivot pins or axels 106*a* and 106*b* are each made of an electrically conductive material such as metal, and provide or enhance an electrical ground connection between the first and second housing portions 102 and 104, through the flanges 102*a* and 104*a*. In those examples, the first and second housing portions 102 and 104 (including the flanges 102*a* and 104*a*) may be made of a metal or other electrically conductive material. As described herein the second housing portion 104 may be electrically connected to a ground conductor 114*c*, via fastener 114*d*.

The pivot pins or axels 106*a* and 106*b* provide or enhance an electrical conduction path between the second housing portion 104 and the first housing portion 102, such that the first housing portion 102 is also electrically connected to the ground conductor 114*c*, through the pivot pins or axels. In some examples, the metal structure of the first and second housing portions 102 and 104 may be coated with a powder coating or other coating for protection against corrosion. However, such coatings can adversely affect a ground connection between the flanges 102*a* and 104*a* of the first and second housing portions 102 and 104. Accordingly, the pivot pins or axels 106*a* and 106*b* can electrically contact the flanges 102*a* and 104*a* and provide or enhance an electrical connection between the flanges 102*a* and 104*a* of the first and second housing portions 102 and 104. In other examples, other suitable pivot or hinge joints may be employed for connecting the first and second housing portions 102 and 104 together for pivotal movement.

The second housing portion 104 includes side walls and end walls that surround and enclose a hollow or partially hollow interior cavity. The inner cavity of the second housing portion is configured to contain electrical conductors and electrical connectors. In particular examples, one or more (or a plurality of) first electrical conductors extend from the driver electronics 110 in the first housing portion 102. In FIG. 6, two electrical conductors 112*a* and 112*b* extend from the driver electronics 110, through or between the flanges 102*a* and 104*a*, through the first end wall of the second housing portion and into the cavity of the second housing portion 104. In addition, the second housing portion 104 has a second wall 104*c* facing opposite the first wall, where the second wall 104*c* has an opening 104*d* through which one or more (or a plurality of) second electrical conductors may extend from the installation environment, into the cavity of the second housing portion 104. In FIG. 6, three electrical conductors 114*a*, 114*b* and 114*c* extend from an electrical cable 114 located in the installation environment (e.g., in a plenum space of a ceiling) into the cavity of the second housing portion 104. In particular examples, the cable 114 may be an AC power cable such as, but not limited to, a standard 110 Volt or 220 Volt (or other suitable voltage) AC power cable provided in modern buildings, homes and other structures.

In certain examples as shown in FIGS. 5 and 6, the second end wall 104*c* of the second housing portion 104 (i.e., the end wall facing opposite the first end wall) has a cable connector 116 that is configured to be selectively connected to (or disconnected from) the electrical cable 114. In particular examples, the cable connector 116 is provided on the second end wall 104*c* of the second housing portion 104 and extends through the opening 104*d*. In certain examples, the second end wall 104*c* is provided at an oblique angle relative to one or more (or each) of the other walls of the second housing portion 104. The oblique angle can be, for example, 45 degrees. In other examples, the oblique angle can be selected from a range of and including 20 degrees to 70 degrees. The oblique angle of the second end wall 104*c* can allow the cable connector 116 to be linearly aligned or more closely aligned with the cable 114 in certain plenum, attic, inner wall or other installation spaces (for example, as the hinged driver housing is passed through the opening 212*a* in the ceiling 212, as described herein).

The cavity in the interior of the second housing portion 104 provides a space in which one or more (or a plurality of) conductors from the electrical cable 114 are connected (through electrical connectors) to one or more (or a plurality of) conductors from the driver electronics 110. In the example in FIG. 6, two conductors 112*a* and 112*b* from the driver electronics 110 are electrically connected to two respective conductors 114*a* and 114*b* from the cable 114, by electrical connectors 118*a* and 118*b*. A third conductor 114*c* from the cable 114 may be a ground conductor and is connected (either directly or through a third connector 118*c*), to a connection mechanism 114*d* (such as, but not limited to a screw, bolt or other threaded fastener, a rivet or the like) on a wall of the second housing portion 104, for example, as a ground connection to connect the second housing portion 104 to ground. The electrical connectors 118*a*, 118*b* and 118*c* may include any suitable electrical connector or connectors such as, but not limited to one or more of a plug and socket connector (male/female connector), a wire nut connector, an in-line splice, a terminal block, a push in connector, or the like.

In certain examples, the second housing portion 104 is configured to be selectively opened or closed to access the cavity and the conductors and connectors in the cavity, for example, to connect or disconnect conductors or to inspect or service connections. Such selective opening and closing of the cavity may be provided by any suitable door, shutter or other opening and closing mechanism. In some examples, such opening and closing of the cavity may be provided by a fastener 104*b* (such as, but not limited to a threaded screw or bolt, or a clip) that holds one or more removable walls 104*e* of the second housing portion 104 to a base 104*f* of the second housing portion, and may be selectively removed or released to temporarily remove the wall. In the example in FIG. 7, the removeable wall 104*e* has an opening or slot through which the threaded fastener 104*b* extends, and the base 104*f* of the second housing portion 104 has a threaded receptacle 104*g* that receives a threaded end of the threaded fastener 104*b*, to secure the removable wall 104*e* to the base 104*f*. A similar threaded receptacle may be provided on the base 102*e* of the first housing portion for receiving the threaded fastener 102*c* and securing the removable wall 102*d* to the base 102*e* of the first housing portion. In those examples, the base 102*e* and 104*f* of each of the first and second housing portions may include a slot 102*f* and 104*h*, respectively, for receiving a projection or extending tab 104*i* and 102*g*, respectively, of the removable wall 104*e* or 102*d*, respectively.

The hinged driver housing 100 may be made by any suitable manufacturing methods. In particular examples, the first and second housing portions 102 and 104 are provided as described herein. The pivot pin or axel 106*a* of the pivot joint 106 may be inserted through openings in the flanges 102*a* and 104*a*, to pivotally connect the flanges (and the housing portions) together. The pivot pin or axel may be retained in the flanges by any suitable mechanism, including, but not limited to heads proved on each end of the pivot pin or axel that do not pass through the openings in the flanges. In other examples, a pivot pin or axel may be formed on or connected to one of the flanges 102*a* or 104*a*, and may be passed through an opening in the other flange 102*a* or 104*a* and be retained with that flange by a head on a free end of the pin or axel. In yet other examples, the pivot joint 106 may be formed by other suitable pivot connections between the first and the second housing portions 102 and 104. In addition, the cable connector 116 may be attached to the end wall 104*c* of the second housing portion 104. In some examples, driver electronics 110 may be inserted and sealed within the first housing portion 102.

In the lighting system 200 shown in FIGS. 5 and 6, the driver electronics 110 is connected to a lighting device 202. The lighting device 202 may include a light source (not shown) and a housing or heat sink member 202*a* on which the light source is mounted. In some examples, the lighting device 202 is configured to be received and installed within an opening in a ceiling, wall or other structure. In those examples, the lighting device 202 may include one or more spring clips, other clips, fasteners or other retaining devices 202*b* that retain and hold the housing or heat sink member 202*a* within an opening in a first (or finished) ceiling, wall or other structure, when the housing or heat sink member 202*a* is inserted into the opening, as described below. In some examples, a flange or lip 202*c* is provided on one end of the housing or heat sink member 202*a* (e.g., the downward facing end in FIGS. 5 and 6), for engaging and abutting a surface of the first (or finished) ceiling, wall or other structure around the opening, when the lighting device 202 is installed in the ceiling, wall or other structure.

In some examples, the lighting device 202 includes a trim member 202*d* that connects to the flange or lip 202*c* (or to the housing or heat sink member 202*a*), on an exposed or viewable side of the ceiling, wall or other structure, as shown in FIG. 5. The trim member 202*d* may have an annular shape and a central opening in alignment with the light source (not shown) on the housing or heat sink member 202*a*, through which light from the light source may pass. The trim member 202*d* may include ornamental or decorative details that are viewable, after the lighting system 200 is installed in a ceiling, wall or other structure. In some examples, the trim member 202*d* may have an inner surface (not shown) of the annular shape that is provided with a reflective coating, layer or treatment. In other examples, the trim member 202*d* may be omitted.

The light source (not shown) of the lighting device 200 is mounted on the housing or heat sink member 202*a* and is arranged to emit light (when energized) in a light emission direction L. In certain examples, the light emission direction L is fixed, once the lighting device 200 is installed. In other examples, the lighting device 200 may include a support structure that supports the light source (or the housing or heat sink member 202*a* on which the light source is mounted), for adjustment of the light emission direction L. In particular examples, the support structure allows adjustment of the light emission direction L about multiple, transverse axes. In other examples, other suitable lighting device configurations may be employed for the lighting device 200.

The light source (not shown) of the lighting device 202 may include any suitable light emitting device or devices. In particular examples, the light source of the lighting device 200 includes one or more LEDs or other light source that generates heat during operation. In such examples, the one or more LEDs (or other light source) may include or be mounted on a circuit board or other support structure. The light source may be secured to and mounted in thermal communication with a light-source mounting surface of the housing or heat sink member 202*a*, such that the housing or heat sink member 202*a* may efficiently receive and conduct heat from the light source.

In certain examples, the housing or heat sink member 202*a* may be in direct contact with the light source, to efficiently transfer heat away from the light source. In certain examples in which the light source includes a circuit board on which one or more light emitting devices are mounted, the circuit board may be mounted in direct contact with a surface of the housing or heat sink member 202*a*, to enhance the ability to transfer heat from the circuit board (or components on the circuit board) to the heat sink member 202*a*. In those examples, the heat sink member 202*a* is configured to conduct and dissipate heat away from the light source, which can significantly improve the efficiency and light output of the one or more LEDs (or other heat-generating light sources). While particular examples described herein include a light source having one or more LEDs, other examples may include other suitable light sources such as, but not limited to one or more halogen, halide, fluorescent, or incandescent light sources, or other electrical discharge or electroluminescence device, or the like.

In particular examples, the lighting system 200 is configured to be installed in or partially in an opening to a plenum, duct or attic space of a ceiling, or in an inner wall space. Typical building, house or other structure designs often include a plenum space, duct space, attic, inner wall space or the like in a ceiling, wall or other structure. It is common for such structures to have electrical conduits or cables, plumbing pipes and other conduits, thermal insulation material, and certain appliances within those spaces, for example, hidden from view. An example of the lighting system 200 installed in a plenum space 210 of a ceiling structure is shown in FIG. 5, and an example of the system 200 in a state of being installed or being removed from the plenum space 210 is shown in FIG. 6.

In FIGS. 5 and 6, the plenum space 210 is located between a finished ceiling 212 and a rough ceiling 214. In some examples, the rough ceiling 214 may be part of a structural support of a roof, or a structural support base of the next higher building level (floor), or another weight-bearing part of the building, house or other structure. Typically, such rough ceilings 214 are made of wood or concrete, metal reinforcements or combinations thereof. The finished ceiling 212 is supported below the rough ceiling 214 by brackets, rafters, or other supporting structure (not shown), and is separated from the finished ceiling 212 by a space 210 (such as a plenum space or an attic space). The finished ceiling 212 may be made of one or more panels of gypsum board, wood, other suitable material, or combinations thereof, and can cover and hide the space 210 (and the rough ceiling 214) from view, with respect to a room or area located below the finished ceiling 212. The finished ceiling 212 may be finished with paint or other finishing material, and can be more aesthetically pleasing than the space 210 and the rough ceiling 214, when viewed from the environment or area below the finished ceiling 212. While the space 210 is shown as a plenum space in a ceiling in FIGS. 5 and 6, similar descriptions apply to an inner wall space having an outer finished wall, or other suitable structures having an outer or finished wall in which a lighting device may be installed.

In the example in FIGS. 5 and 6, an opening 212*a* is formed or provided in the finished ceiling, in a desired installation location for the lighting device 202. The opening 212*a* has a size and shape suitable for receiving at least a portion of the lighting device 202 through the opening 212*a*. In certain examples, the opening 212*a* may be formed sufficiently near an electrical power source in the plenum space 210, for example the electrical cable 114 (such as, but not limited to a typical AC power cable), such that the cable 114 may be reached by a user's hand or by a tool, through the opening 212*a*, from the exposed environment (the space below the finished ceiling in FIGS. 5 and 6).

In addition, the driver electronics 110 may be placed or otherwise provided within the first housing portion 102 of the hinged driver housing 100, with the electrical conductors 112*a* and 112*b* extending into the second housing portion 104 of the hinged driver housing 100. Once the electrical cable 114 is reached as described above, the electrical conductors 114*a*, 114*b* and 114*c* of the cable 114 may be connected to the electrical conductors 112*a* and 112*b*, and to a ground terminal as described herein and shown in FIG. 6. In addition, the cable 114 may be connected to the cable connector 116. In certain examples, a length of an end portion of the cable 114 may be pulled through the opening 212*a*, into the exposed environment (the space below the finished ceiling 212 in FIGS. 5 and 6), before making the electrical connections. That can allow a user (located in the exposed environment) to more easily and accurately connect the electrical conductors 114*a*, 114*b* and 114*c* (and to more easily and accurately connect the cable 114 to the cable connector 116), while the hinged driver housing 100 is outside of the plenum space 210.

In addition, the one or more electrical conductors 111 are connected from the driver electronics 110 to the light source of the lighting device 202. In certain examples, the connection of the conductors 111 to the lighting device 202 may be carried out before the connection of the conductors 112*a* and 112*b* to the conductors 114*a* and 114*b*. In other examples, the connection of the conductors 111 to the lighting device 202 may be carried out after the connection of the conductors 112*a* and 112*b* to the conductors 114*a* and 114*b*.

Once the electrical connections are made, the hinged driver housing 100 is passed through the opening 212*a* in the finished ceiling 212, from the exposed space, and into the plenum space 210, along with any end portion of the cable 114 that had been pulled through the opening 212*a*. The hinged driver housing 100 may be bent.

To fit into a relatively narrow plenum space 210, the hinged driver housing 100 is bent about its pivot axis A (in a non-linear arrangement in which the longitudinal dimensions $L_1$ and $L_2$ of the housing portions are transverse to each other to define a non-linear angle, for example, as shown in FIG. 6). In that shape, the hinged driver housing 100 can be moved more easily around a corner or about 90 degrees, as the hinged driver housing 100 is being passed (e.g., vertically) through the opening 212*a*, and into a volume of the plenum space 210 that has a relatively large horizontal dimension, but a relatively small vertical dimension H.

One the hinged driver housing 100 is partially (or fully) received in the plenum space 210, the hinged driver housing 100 may unbend about the pivot axis A (such that the first and second housing portions 102 and 104 have their longitudinal axes in linear (or more linear) alignment with each other, for example, as in FIG. 5). In that state, the hinged driver housing 100 may easily fit within the plenum space and may be placed at a desired location, for example, on the finished ceiling 212, near the opening 212*a*, as shown in FIG. 5. Accordingly, the driver electronics 110 and electrical connections between the driver electronics and conductors of a power source cable 114 are contained and held within the enclosed housing portions of the hinged driver housing 100. In addition, the hinged or pivotal joint 116 connecting the first and second housing portions 102 and 104 of the driver housing 100 allows the hinged driver housing 100 (including driver electronics and electrical connections between the driver electronics and one or more conductors of a power source cable) to be readily installed and fitted in narrow plenum spaces, and can simplify an installation operation.

Once the hinged driver housing 100 is placed in the plenum space 210, the lighting device 202 may be mounted to the finished ceiling 212, over the opening 212*a*. In certain examples, the lighting device 202 is passed at least partially through the opening 212*a* (along with the length of the electrical cable 111 and a length of the safety cable 113) from the exposed side of the finished ceiling 212 (the side facing downward in FIGS. 5 and 6). The lighting device 202 is passed sufficiently through the opening 212*a* such that the heat sink member 202*a* (or a portion of the heat sink member 202*a*) is located within the plenum space. In particular examples, the diameter (or outer peripheral shape) of the opening 212*a* is sufficient to receive at least a portion of the lighting device 202, but is smaller than the outer diameter (or outer peripheral shape) of the flange 202*c*, such that the flange 202*c* abuts an edge of the finished ceiling 212 around the opening 212*a*, and covers the edge of the opening 212*a*. In particular examples, the flange 202*c* engages and is flush with or directly abuts the exposed surface (the downward-facing surface in FIGS. 5 and 6) of the finished ceiling 212.

In examples in which the lighting device 202 has spring clips 202*b*, the spring clips 202*b* are passed at least partially through the opening 212*a* and retain the lighting device 202 on the opening 212*a* of the finished ceiling 212. In examples in which the lighting device 202 has a trim member 202*d*, the trim member may be attached to the heat sink member 202*a*, the flange 202*c* or another portion of the lighting device 202. In an installed state, as shown in FIG. 5, the lighting device 202 may receive electrical power signals from the driver electronics 110, to generate and emit light in a direction L. In certain examples, the lighting device 202 may be adjustable, to adjust the direction L about one or more (or a plurality of transverse) axes.

From an installed state, as shown in FIG. 5, the lighting system 200 may be removed from its installed state by a similar operation as described above, but performed in reverse. For example, the trim member 202*d* may be removed and the lighting device 202 may be unclipped and released from the opening 212*a*. The lighting device 202 may be removed from the opening 212*a*, and the cable 111 or the cable 113 may pull the hinged driver housing 100 toward the opening 212*a*. A user may reach the hinged driver housing 100 through the opening 212*a* and may bend the driver housing 100 about its pivot joint 106, to allow the driver housing 100 to fit (or more easily fit) through the opening 212*a*, and into the exposed environment (the environment below the finished ceiling 212). Once the hinged driver housing 100 has been removed from the plenum space, the electrical connections and conductors within the second housing portion 104 may be inspected, disconnected or serviced, as desired. Additionally, the connection of the cable 114 to the cable connector 116 may be inspected, disconnected or serviced, as desired.

In various examples described herein, certain components are described as having a round shape, cup shape, square shape, rectangular shape, or cylindrical shaped portions, including, but not limited to the housing portions 102 and 104. However, in other examples, those components may have other suitable shapes including, but not limited to shapes having polygonal or other circular or non-circular cross-sections or combinations thereof The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device system comprising:

a lighting device assembly having a light source for generating light;

driver electronics connected to provide one or both of a power signal or a control signal to the light source, the driver electronics including a first one or more electrical conductors for electrical connection to one or more power source conductors, and a second one or more electrical conductors electrically connected to the light source;

a driver housing separated from the lighting device assembly, and connected to the light source through at least one electrical conductor, the driver housing having:

a first housing portion that holds and retains the driver electronics;

a second housing portion configured to contain or hold one or more electrical connectors for connecting the first one or more electrical conductors to the one or more power source conductors; and a pivotal joint connecting the first housing portion and the second housing portion together, for pivotal movement relative to each other;

wherein the pivotal joint includes at least one electrically conductive pivot axle that provides an electrical ground connection of the first housing portion with the second housing portion; and wherein at least one of the housing portions includes a connector for electrically connecting a ground conductor of an electrical cable to the at least one housing portion, to ground the first and second housing portions.

2. The lighting device system of claim 1, wherein the first one or more electrical conductors extend from the driver electronics held by the first housing portion, to the second housing portion.

3. The lighting device system of claim 1, wherein the second housing portion includes a connector for connecting to the electrical cable, the connector being selectively connected and selectively disconnected from a connected state.

4. The lighting device system of claim 1, wherein the first housing portion has an interior cavity in which the driver electronics are contained, where the second housing portion has an interior cavity in which the one or more electrical connectors are contained.

5. The lighting device system of claim 4, wherein the first housing portion has a wall that is selectively moveable or removable to allow access to the interior cavity of the first housing portion for installation, removal, inspection or servicing of the driver electronics.

6. The lighting device system of claim 5, wherein the second housing portion has a wall that is selectively moveable or removable to allow access to the interior cavity of the second housing portion for connection, disconnection, inspection or servicing of the driver electronics.

7. The lighting device system of claim 1, wherein:

the first housing portion has a side facing the second housing portion, and at least one first protrusion or flange extending from that side;

the second housing portion has a side facing the first housing portion, and at least one second protrusion or flange extending from that side;

the at least one pivot axel extending between the at least one of the first or second protrusion or flanges to pivotally connect the at least one first protrusion or flange with the at least one second protrusion or flange.

8. The lighting device system of claim 7, wherein the second housing portion has a second side facing opposite to the first side of the second housing portion, the second side defining an angle relative to one or more other sides of the second housing portion, where the angle is selected from the range of and including 20 degrees to 70 degrees.

9. The lighting device system of claim 1, wherein the driver electronics includes a safety cable extending from the driver electronics to the lighting device assembly.

10. The lighting device system of claim 1, wherein the first one or more electrical conductors extend through the pivotal joint.

11. The lighting device system of claim 1, further comprising a cable strain relief member provided on the first housing portion, wherein the second one or more electrical conductors extend from the driver electronics held by the first housing portion, through the cable strain relief member to the lighting device.

12. The lighting device system of claim 1, wherein the second housing portion includes the connector for electrically connecting a ground conductor of the electrical cable to the second housing portion, to ground the second housing portion.

13. A driver housing for holding driver electronics of a lighting device system, the driver housing comprising:

a first housing portion configured to hold and retain the driver electronics;

a second housing portion configured to contain or hold one or more electrical connectors for connecting the first one or more electrical conductors to the one or more power source conductors; and a pivotal joint connecting the first housing portion and the second housing portion together, for pivotal movement relative to each other;

wherein the pivotal joint includes at least one electrically conductive pivot axle that provides an electrical ground connection of the first housing portion with the second housing portion; and wherein at least one of the housing portions includes a connector for electrically connecting a ground conductor to the at least one housing portion, to ground the first and second housing portions.

14. The driver housing of claim 13, further comprising driver electronics configured to connect to a light source of a lighting device to provide one or both of a power signal or a control signal to the light source, the driver electronics including a first one or more electrical conductors for electrical connection to one or more power source conductors, and a second one or more electrical conductors for electrically connecting to the light source.

15. The driver housing of claim 14, wherein the first one or more electrical conductors extend from the driver electronics held by the first housing portion, to the second housing portion.

16. The driver housing of claim 14, wherein the second housing portion includes a connector for connecting to an electrical cable having one or more power source conductors.

17. The driver housing of claim 14, wherein the first housing portion has an interior cavity configured to contain the driver electronics, where the second housing portion has an interior cavity configured to contain one or more electrical connectors for electrical connection of the one or more power source conductors with the first one or more electrical conductors.

18. The driver housing of claim 17, wherein the first housing portion has a wall that is selectively moveable or removable to allow access to the interior cavity of the first housing portion for installation, removal, inspection or servicing of the driver electronics.

19. The driver housing of claim 17, wherein the second housing portion has a wall that is selectively moveable or removable to allow access to the interior cavity of the second housing portion for connection, disconnection, inspection or servicing of the driver electronics.

20. The driver housing of claim 13, wherein:

the first housing portion has a side facing the second housing portion, and at least one first protrusion or flange extending from that side;

the second housing portion has a side facing the first housing portion, and at least one second protrusion or flange extending from that side;

the at least one pivot axel extends between the at least one of the first or second protrusion or flanges to pivotally connect the at least one first protrusion or flange with the at least one second protrusion or flange.

21. The driver housing of claim 20, wherein the second housing portion has a second side facing opposite to the first side of the second housing portion, the second side defining an angle relative to one or more other sides of the second housing portion, where the angle is selected from the range of and including 20 degrees to 70 degrees.

22. The driver housing of claim 20, further comprising a cable connector on the second side of the second housing portion.

* * * * *